US005876358A

United States Patent [19]

Goebel

[11] Patent Number: 5,876,358

[45] Date of Patent: Mar. 2, 1999

[54] THERAPEUTIC DEVICE AND ARRANGEMENT FOR TREATING PARAVERTEBRAE

[76] Inventor: Dieter Goebel, Weinstrasse 3, 80333 Munich, Germany

[21] Appl. No.: 593,568

[22] Filed: Jan. 30, 1996

[30] Foreign Application Priority Data

Jan. 30, 1995 [DE] Germany ..... 295 01 423 U
Feb. 15, 1995 [DE] Germany ..... 195 05 065.7

[51] Int. Cl.[6] ..... A61H 7/00

[52] U.S. Cl. ..... 601/98; 601/101; 601/103; 601/97; 601/90; 601/93; 601/95

[58] Field of Search ..... 601/98, 99, 102, 601/115, 116, 118, 122, 128, 134, 89, 90, 92, 93, 94, 95

[56] References Cited

U.S. PATENT DOCUMENTS

| | | | |
|---|---|---|---|
| 2,909,173 | 10/1959 | Anderson et al. | 128/99 |
| 3,633,571 | 1/1972 | Shinagawa | 601/118 |
| 3,687,133 | 8/1972 | Grubelic | 601/103 |
| 3,736,920 | 6/1973 | Mathers et al. | 601/116 |
| 3,881,469 | 5/1975 | Kanemitsu | 601/115 |
| 5,020,518 | 6/1991 | Spears et al. | 601/116 |
| 5,038,757 | 8/1991 | Yamasaki | 601/103 |
| 5,618,262 | 4/1997 | Rene | 601/116 |

FOREIGN PATENT DOCUMENTS

| | | |
|---|---|---|
| 1 920 105 | 7/1965 | Germany . |
| 3 312 060 | 10/1984 | Germany . |

*Primary Examiner*—Richard J. Apley
*Assistant Examiner*—Benjamin Koo
*Attorney, Agent, or Firm*—Foley & Lardner

[57] ABSTRACT

A therapeutic arrangement for treating paravertebrae has a bed and a therapeutic device positioned in an opening formed in the bed. The therapeutic device has four movable cushions arranged at four corners of an H-shaped center frame. The center frame has a transverse member and two lateral pivotal arms connected to the ends of the transverse member, forming an H-shape. Each end of the pivotal arms carries one of the four cushions. The pivotal arms are connected by a coupling arm in one embodiment, each connected to an electro-mechanical moving device in another embodiment, and each connected to a pneumatic spring in yet another embodiment to control the movement of the pivotal arms so that the pads at the opposite ends of the same pivotal arm move in the opposite directions (up and down), enabling one of the pads attached to one of the pivotal arms to move in the same direction as one of the pads attached to the other of the pivotal arms. Specifically, the pivotal arms are adapted to rotate (twist) in opposite directions, thus enabling diametrically opposite ends of the pivotal arms to move in the same direction.

26 Claims, 2 Drawing Sheets

THERAPEUTIC DEVICE AND ARRANGEMENT FOR TREATING PARAVERTEBRAE

Applicant hereby incorporates the disclosures of the following priority documents by reference: German Document 295 01 423.1 filed Jan. 30, 1995 and German Document 195 05 065.7 filed Feb. 15, 1995.

BACKGROUND

The invention relates to therapeutic arrangements for a paravertebral therapy of a human body. The effect desired and achieved by the present invention is the automation of a manual therapy mobilizing the small joints (vertebra facets) of the lumbar vertebrae and the dorsal vertebrae in order to recover their initial or normal anatomic position.

The topographic anatomic circumstances on level D4 (fourth dorsal vertebra) sometimes lead to short-arched right-convex structural scoliosis with counter-motion of the lower cervical vertebrae. Vertebra blockades or level D3, D4 cause obstinate pain in the arms. In this connection, in case of injuries of the upper extremities (arms) algodystrophies can be associated with this clinical picture.

According to W. H. Illi, the fourth dorsal vertebra has the smallest movement arch at the dorsal vertebrae. Further it represents the tectonic basis for the torsion of the cervical vertebrae and the upper dorsal vertebrae when bending the head forward.

From the anatomic point of view, in the thorax the hilum of the lung projects itself on the fifth dorsal vertebra. The Bifurcatio tracheae projects itself on the fourth dorsal vertebra. The aortic arch extends from behind in arcuated form over the left stem bronchus ventrally, bending around it in order to redescend from it. These asymmetric pulsating forces easily explain a curvature to the right in the region of the fourth dorsal vertebra. In most cases this curvature is short-arched and may possibly be intensified by a growth discrepancy of the mediastine. This growth discrepancy is likely to be a natural variation on the longitudinal plane, just as the funnel breast is a result of a respective shortening of the mediastine on the anterior and posterior plane.

The upper part of the breast of the Pars sympathica is developed particularly strong. The part of the breast of the Truncus sympathicus is situated besides the dorsal vertebrae in front of the intercostal vessels and is covered by the pleura.

The cord extremity of the Sympathicus is connected with the spinal nerve by the Rami communicantes, the fibers of which derive from l-he last cervical segment C8 on to the second or third lumbar segment.

SUMMARY

In view of the above explained anatomic conditions, it is an object of the invention to recover segmental dislocations of the small joints (the vertebra facets) in the lumbar and dorsal vertebrae and to neutralize or remove blockades of the vertebra facets. In other words, the small joints are to be mobilized in order to enable them to return to their initial or normal anatomic position without necessitating the treatment by a specialist.

This object is achieved by providing a therapeutic arrangement comprising several cushion or pad-shaped element, which are being moveable out of a plane. A center frame construction carries, at its corners, individual ones of the elements arranged in pairs at each pivotable arm of the frame construction. The pivotable arms are arranged at a transverse member in pivotable fashion to enable one of the elements of a first pair of the elements to move in the same direction off the frame plane together with one of the elements of the other pair.

The elements or pelots are located on the respective ends of the mutually pivotable arms. The pivoting movement of the arms is achieved by arranging them at a transverse member. Therefore, one pair of the elements respectively is pivotable together on one arm, however, in opposite directions, leaving the frame plane, which plane is defined by the three supports the transverse member and the two pivotable arms in a neutral position. One of the elements, respectively, of a first pair of elements is moveable in the same direction together with one of the elements of the other pair.

In the neutral position the frame support is H-shaped, the H also defining the frame plane.

If a coupling member is used, which is pivotably mounted on an auxiliary support member, transverse pelots are urged to pivot in opposite directions. The transversely arranged pelots (with respect to the middle of the therapeutic arrangement) move in the same direction.

The same transverse pivoting movement—around the stationary axis z—is achieved by using electric motors. They move in opposite directions and their stroke is adjustable.

A pivoting movement deviating from the transverse pivoting movement is achievable if pneumatic springs operating at each pivotable arm are used only.

The therapeutic arrangement is suitable for forced transverse pivoting movements (with the motors) as well as for manually supported pivoting movements and also for self therapy, the user himself mobilizing his small joints in the vertebrae by slight body movement.

The therapeutic arrangement is adapted to be mounted horizontally (with respect to the frame plane) on a foot member as well as vertically on a frame or wall. In the latter case the person to be treated is standing, whereas in case of a horizontal application, the person is lying on a bed or bench in which a cutout is provided, through which the the patient's back is accessible by the therapeutic arrangement.

The pivoting movement is by certain means adapted to be limited either mechanically or by adjusting the stroke of the electric motors. Pivoting height, pivoting frequency, and also phase relation of the counter movement of the two pivoting arms are adjustable.

The therapeutic arrangement is adaptable to the patient by simple mechanical adjustment possibility of the pelots being adjustable in one or two directions, perpendicular to each other. Thus, the therapist has the facility of adapting the paravertebral influence on the vertebra facets to each individual case.

Disc-shaped pressure cushions, the plane of which is approximately in perpendicular alignment with the frame plane, are provided to be used as pelots. The disc-shaped pressure cushions are adapted to be mounted in a pivotable fashion on the pivoting arms.

The coupling member already described in connection with the mechanical coupling of the transverse pivoting movement may be easily provided in V-shape, its center being mounted pivotably on an auxiliary support member to enable the two V-shaped arms to move in opposite directions and to direct the pivotable arms bearing the pelots in a transversely opposite direction.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

FIG. 5*a* is front view of FIG. 4 showing a coupling arm; FIG. 5*b* shows an electromechanical embodiment having two slide rod motors, eliminating the coupling arm; FIG. 5*c* is similar to FIG. 5*b* using two pneumatic springs.

DETAILED DESCRIPTION

Figure 1:
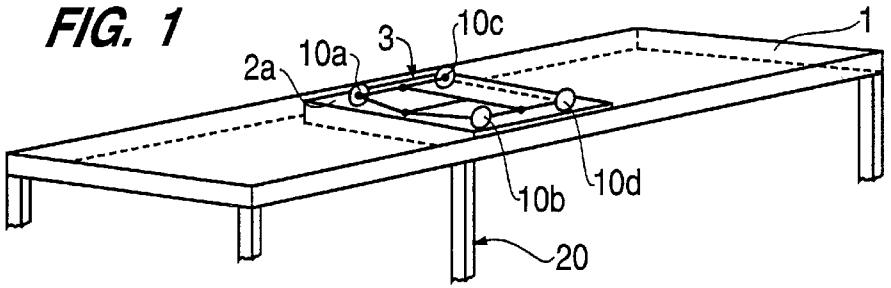
FIG. 1 is an overall view of a therapeutic arrangement according to the present invention, including a bed and a therapeutic device, which is schematically shown carrying four pelots at its four corners.

FIG. 1 shows a therapeutic arrangement comprising a bed or bench 1 and a therapeutic device 3 located approximately in the middle of the bed 1, which has a rectangular or square opening 2*a* adapted to receive the therapeutic device 3. The therapeutic device 3 is adapted to stand independently on a main support 20 having a foot 21. The front of the foot 21 may serve as an orientation member.

Figure 2:
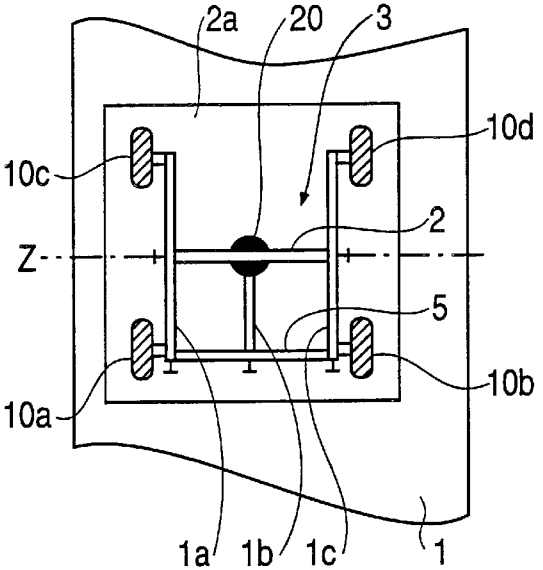
FIG. 2 is a top view of the therapeutic device shown in FIG. 1, illustrating the four pelots, which is positioned in a square opening in a bed or bench.
Figure 3:
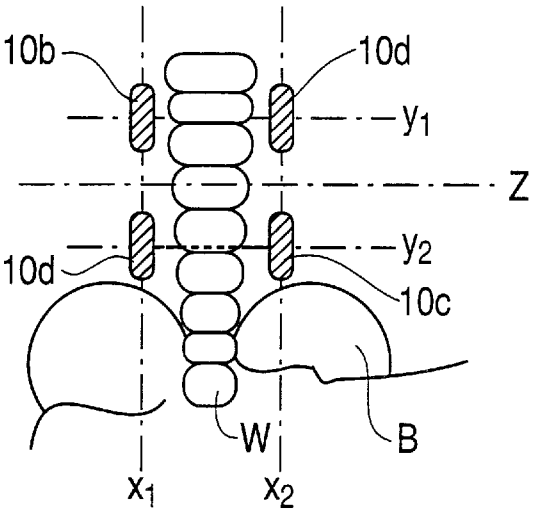
FIG. 3 is a schematic view shown from the bottom of the therapeutic device shown in FIG. 1, illustrating the reproduction of the pressure marks of the pelots when a person is lying with the back on the therapeutic arrangement.

FIGS. 2 and 3 it can be seen that the pelots 10 form a square or rectangle with their contact points at the human back in paravertebral position with regard to vertebrae W. The pad-shaped elements 10 are pivotable, as indicated by axis z in FIG. 3, which show the reproduction from underneath through the opening 2*a* to the back of the person treated. The vertebrae W with its individual lumbar and dorsal vertebrae is illustrated. Also, the pelvis B is traced schematically. The pelots 10 act paravertebrally on the vertebrae to neutralize torsional blockades of the vertebrae (lumbar and/or dorsal). While the axes $y_1$, $y_2$ and $x_1$, $x_2$ are pivoted out of the paper plane, the axis of rotation z remains in the paper plane and the pelots 10*b* and 10*d* for example move around the axis z in the clockwise direction whereas the pelots 10*a* and 10*c* move in the counter-clockwise direction around the axis z. Thus the pelots 10*c* and 10*b* together move upwardly out of the paper plane, whereas pelots 10*a* and 10*d* change their position to move downwardly. The transversely arranged pelots are thus subjected to a vertical movement component in the same direction, which component is referred to as h in FIG. 4 and as h1 and h2 specifying their direction in FIG. 5*a*.

Figure 4:
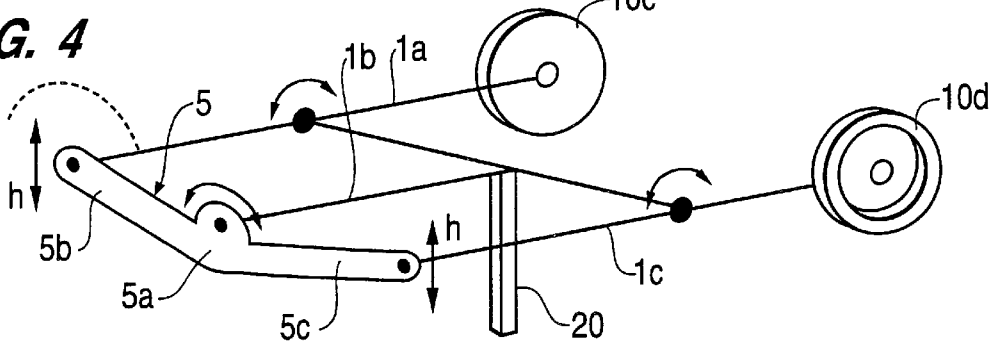
FIG. 4 is a schematic perspective view of the therapeutic device of FIG. 1, with two of the pelots omitted.

The mechanical arrangement corresponding to this function of movement in opposite direction of the transversely arranged pelots is shown in FIGS. 2 and 4. FIG. 4 shows a front coupling arm comprising a pivotal section 5*a* and two arms 5*b* and 5*c* protruding therefrom. It should be noted that FIG. 4 omits the two front pelots 10*a* and 10*b* for clarity of illustration. The mechanical arrangement comprises a main bar-shaped section or transverse member 2 in which the above mentioned common pivotable axis z extends. The transverse member 2 is firmly attached to the upper end of the support 20. At its two ends two rack sections 1*a* and 1*c* are provided which sections are also tube-shaped. They are pivotable deformable-twisting around the axis z. On the respective ends of these pivotable arms 1*a*, 1*c* the pelots 10*a*, 10*b*, 10*c* and 10*d* are mounted. They may be provided as vertically disposed disc-shaped cushions.

In one embodiment the pivoting movement of the pivotable arms or rack sections 1*a*, 1*c* in opposite directions is achieved by a pivotable arm 5 serving as a mechanical coupling. The pivotable arm 5 is shown in FIG. 2 and described in detail with respect to FIG. 4 and FIG. 5*a*. Its pivot point is mounted on an auxiliary support 1*b* protruding from the main bearing (upper end of the support 20).

Figure 5B:
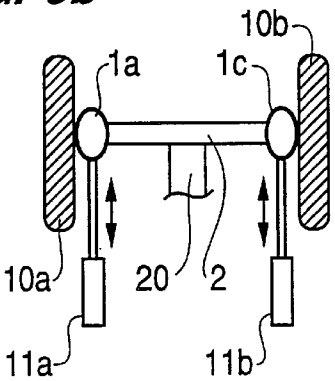
FIGS. 5*a*, 5*b*, 5*c*, show alternative embodiments showing how two of the pelots may be moved.
Figure 5A:
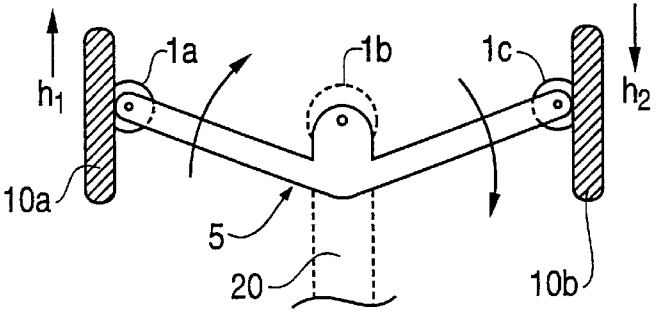

The auxiliary support 1*b* and the pivotable coupling member or front coupling arm 5 are shown perspectively in FIG. 4 and described in detail in a front view in FIG. 5*a*. The member coupling 5 transfers the upward movement $h_1$ of the pelot 10*a* to the other side of the therapeutic arrangement to result in a downward movement $h_2$ of the pelot 10*b*. The pelots 10*c* and 10*d*, which are firmly attached to the respective other ends of the lateral longitudinal members or track sections 1*a* and 1*c*, move simultaneously with the upward movement of the pelt 10*a* and the downward movement of pelot 10*b*. The pelot 10*c* also moves in a direction $h_2$ just as the transversely opposite the pelot 10*b*, and pelot 10*d* moves in the upward direction $h_1$, just as the transversely opposite pelot 10*a*.

Thus, a slight: movement of the person to be treated and lying on bed 1, leads to a movement of all four pelots and to the exertion of counter-paravertebral mobilization forces, in order to influence or act on torsional blockades at the lumbar or dorsal vertebrae and to neutralize them.

Figure 5C:
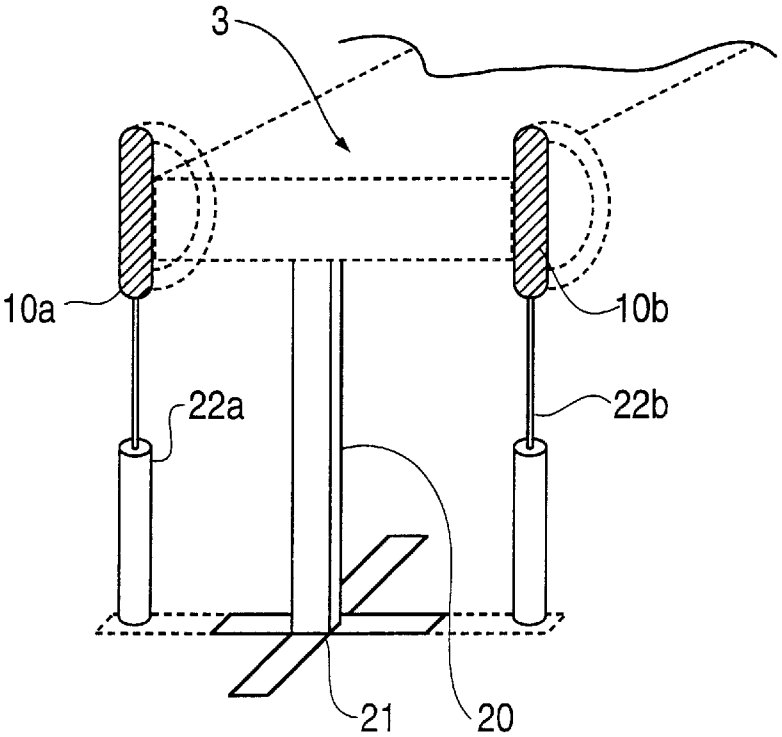

The embodiment, wherein the person to be treated is able to set the pelots in a coupled pivoting movement by moving himself, is supplemented by an automated variation as shown in FIG. 5*b* or 5*c*. In FIG. 5*b* two electric motors 11*a* and 11*b* are driven in opposite direction and transfer the upward and downward movements to the lateral longitudinal members 1*a* and 1*c* via a steering rack, the members 1*a* and 1*c* moving the pelots mounted on their corners. The pivotable coupling member 5 and the auxiliary arm 1*b* are not necessary in this embodiment. The embodiment according to FIG. 5*c* also does not need an auxiliary arm 1*b* and a pivotable coupling member 5, but it works with two pneumatic springs 22*a*, 22*b* exerting their forces in the same way as the mentioned motors 11*a* and 11*b*. One pneumatic spring respectively engages one of the pelots 10*a*, 10*b*, thus permitting its yielding support.

The paravertebral therapy forces are adapted to be adjusted by the physiothererapist or by the user himself by controlling the stroke control of the motors or by adjusting the spring resistance or resilience of the pneumatic springs 22*a*, 22*b*. Besides the forces, the stroke is also adjustable by moving the steering racks of the motors 11*a* and 11*b* upwardly and downwardly only within predetermined limits.

An adjustment of the rotating or pivoting movement may also be effected with the coupling member 5, Off an adjustable arrangement for the limitation of the pivoting movement is provided at the pivot bearing 5*a* (approximately in the middle of the member), located at the auxiliary member 1*b*, which arrangement allows a pivoting movement of the pivotable coupling member 5 only within certain limits. Angles between 10° and 20° are possible, thus achieving a sufficient upward and downward movement of the pelots 10 in the sense of a successful therapy.

The pivoting movement of the coupling member may also be achieved by providing a single rotating drive at the auxiliary member 1*b*.

Alternatively, in this example, the two pneumatic springs 22*a* and 22*b* can be replaced by one single hard pneumatic spring located in the main support 20, so that the entire pelot bearing arrangement 3—as indicated schematically—is supported by a hard pneumatic spring. The pneumatic spring is located between the foot 21 and the upper end of the main support 20. Although the support 20 can be shown in all examples, the arrangement for the pivoting movement of the pelots, as illustrated in FIG. 5*c*, may also be mounted vertically or attached to a pivotable foot member. It is suited for a self-therapy as well as for use by a chiropractor or physiothererapist.

Figure 6:
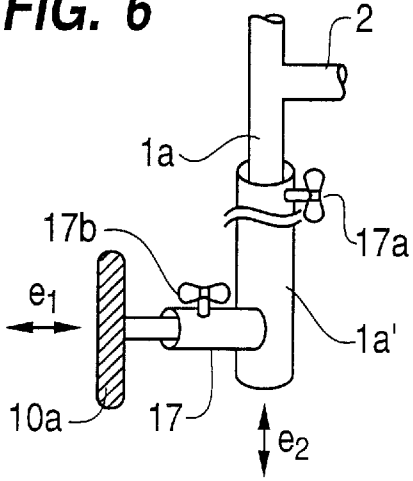
FIG. 6 shows an adjustable pelot that can be adjusted in two perpendicular directions.

FIG. 6 illustrates that the pelots—here as an example pelot 10*a*—can be adjusted in two directions $e_1$ and $e_2$ in perpendicular alignment to each other. These perpendicular directions extend in the direction of the axis $x_2$ and $y_1$ of FIG. 3. By these two adjustments, the arrangement for pivoting movement of the pelots may be adapted to the individuals to be treated, the distance $x_1$–$x_2$ (see FIG. 3) in transverse direction with respect to the vertebrae W as well as the distance $y_1$–$y_2$ (see also FIG. 3) in the longitudinal direction with respect to the vertebrae W being adjustable. In most cases, a principal adjustment in the longitudinal direction y with respect to the vertebrae W is sufficient. It is not absolutely necessary to provide the transverse distances in an adjustable fashion; they may also be provided in a slightly variable fashion.

This is illustrated in a constructive embodiment of FIG. 6 wherein a bushing 17 receives an adjustable tube being attached to the pelot 10*a* and clamps the adjustable tube by means of a fly nut 17*b*.

In the same way, a T-piece 1*a* may be provided at the connection of the transverse member 2 or the lateral longitudinal member 1*a* respectively, the T-piece not providing a flexible connection, as described in FIG. 2. In this case the flexible connection is located at the transverse member 2, in order to enable the entire T-piece 1*a* to pivot. By this means, the bushing/slide rod connection is adjustable in direction $e_2$ and may be fixed by a thumb screw 17*a*.

What is claimed is:

1. A therapeutic device for treating paravertebrae, comprising:

a center frame having a transverse member, a first pivotal arm having a first portion and a second portion and a second pivotal arm having a first portion and a second portion, the first and second pivotal arms being pivotally connected to the transverse member at separate locations, wherein the center frame is adapted to be connected to a support; and a plurality of pads, each connected to one of the first and second portions of the first and second pivotal arms, each of the first and second pivotal arms thus carrying a pair of the pads, wherein the first and second pivotal arms are adapted to pivot in opposite directions relative to each other such that one of the pads connected to the first pivotal arm moves in the same direction as one of the pads connected to the second pivotal arm, out of a plane of the center frame.

2. A therapeutic device according to claim 1, wherein the transverse member and the first and second pivotal arms form an H-shape in the center-frame plane at a neutral position.

3. A therapeutic device according to claim 1, wherein the first pivotal arm is connected to one end of the transverse member and the second pivotal arm is connected to another end of the transverse member.

4. A therapeutic device according to claim 1, wherein the first and second pivotal arms and the transverse member are substantially H-shaped, with ends of the transverse member connecting the first and second pivotal arms.

5. A therapeutic device according to claim 2, wherein opposite ends of the first and second pivotal arms are adapted to move in the same direction such that the pad connected to the first portion of the first pivotal arm moves in the same direction as the pad connected to the second portion of the second pivotal arm.

6. A therapeutic device according to claim 5, further comprising means for adjusting each of the pads with respect to the traverse member in two perpendicular directions in the plane of the center frame.

7. A therapeutic device according to claim 6, wherein a length between the pads connected to the first and second portions of each of the first and second pivotal arms and a width between the pads connected to the first and second portions of the first and second pivotal arms are adjustable.

8. A therapeutic device according to claim 5, wherein the pads each are disc-shaped pressure cushions in perpendicularly alignment with the center-frame plane.

9. A therapeutic device according to claim 8, wherein the cushions are pelots.

10. A therapeutic device according to claim 5, wherein the transverse member is adapted to be mounted to an upper end of the support, which is adjustable in height.

11. A therapeutic device according to claim 5, further comprising a movement controller connected to the first and second pivotal arms, the movement controller enabling the first and second pivotal arms to move in the opposite directions, permitting a diagonal pivoting movement, where the pad connected to the first portion of the first pivotal arm moves in the same direction as the pad connected to the second portion of the second pivotal arm, and the pad connected to the second portion of the first pivotal arm moves in the same direction an the pad connected to the first portion of the second pivotal arm, out of a plane of the center frame.

12. A therapeutic device according to claim 11, wherein the movement controller comprises an auxiliary support member extending substantially parallel with the first and second pivotal arms and connected to the transverse member; and a coupling member pivotally connected to the auxiliary support member and to the the first and second pivotal arms, wherein the coupling member is pivotally mounted substantially parallel to the transverse member.

13. A therapeutic device according to claim 12, wherein the coupling member has two legs joining at an obtuse angle, forming a V-shape, and a center mounting section where the two legs join, wherein the center mounting section is pivotally connected to the auxiliary support member.

14. A therapeutic device according to claim 11, wherein the movement controller comprises at least one sliding rod motor operatively connected to the first and second pivotal arms, wherein the first and second pivotal arms are moveable out of the center-frame plane with the slide rod motor.

15. A therapeutic device according to claim 14, wherein the movement controller comprises two sliding rod motors, each connected to one of the first and second pivotal arms.

16. A therapeutic device according to claim 11, wherein the movement controller comprises at least one pneumatic spring operatively connected to the first and second pivotal arms.

17. A therapeutic device according to claim 16, wherein the movement controller comprises two pneumatic springs, each connected to one of the first and second pivotal arms.

18. A therapeutic device according to claim 11, further comprising a limiting means for limiting the diagonal pivoting movement of the first and second pivotal arms.

19. A therapeutic device according to claim 18, wherein the limiting means is adjustable.

20. A therapeutic arrangement for treating paravertebrae, comprising:

a support;

a self supporting bed having an opening;

a center frame having a transverse member, a first pivotal arm having a first portion and a second portion and a second pivotal arm having a first portion and a second portion, the first and second pivotal arms being pivotally connected to the transverse member at separate locations, wherein the center frame is fixedly connected to the support and positioned in the bed opening; and a plurality of pads, each connected to one of the first and second portions of the first and second pivotal arms, each of the first and second pivotal arms thus carrying a pair of the pads, wherein the pads extend above the bed through the bed opening, wherein the first and second pivotal arms are adapted to pivot in opposite directions relative to each other such that the pad connected to the first portion of the first pivotal arm and the pad connected to the second portion of the second pivotal arm move substantially downwardly while the pad connected to the second portion of the first pivotal arm and the pad connected to the first portion of the second pivotal arm move substantially upwardly, out of a plane of the center frame.

21. A therapeutic arrangement according to claim 20, wherein the transverse member and the first and second pivotal arms form an H-shape in the center-frame plane at a neutral position, wherein the first portion of the first pivotal arm and the first portion of the second pivotal arm are positioned at one side relative to the transverse member, and the second portion of the first pivotal arm and the second portion of the second pivotal arm are at a side opposite the one aide relative to the transverse member.

22. A therapeutic arrangement according to claim 21, wherein opposite ends of the first and second pivotal arms are adapted to move together in the same direction, either substantially downwardly or upwardly.

23. A therapeutic device according to claim 22, further comprising a movement controller connected to the pivotal arms, the movement controller enabling the first and second pivotal arms to move in the opposite directions relative to each other, where the pad connected to the first portion of the first pivotal arm moves in the same direction as the pad connected to the second portion of the second pivotal arm, and the pad connected to the second portion of the first pivotal arm moves in the same direction as the pad connected to the first portion of the second pivotal arm, out of a plane of the center frame.

24. A therapeutic arrangement according to claim 22, wherein the center frame is isolated from the bed.

25. A therapeutic arrangement according to claim 20, wherein the first pivotal arm is connected to one end of the transverse member and the second pivotal arm is connected to another end of the transverse member.

26. A therapeutic arrangement according to claim 20, wherein the first and second pivotal arms and the transverse member are substantially H-shaped, with ends of the transverse member connecting the first and second pivotal arms.

* * * * *